US006006477A

United States Patent [19]

Ko

[11] Patent Number: 6,006,477

[45] Date of Patent: Dec. 28, 1999

[54] UMBRELLA ROD STRUCTURE OF MULTIPLE TUBES

[76] Inventor: Chin Sung Ko, No. 27-1, Lane 188, Sec. 3, Chin Mar Rd., Changhua City, Taiwan

[21] Appl. No.: 09/033,955

[22] Filed: Mar. 3, 1998

[51] Int. Cl.[6] ..... A45B 19/00

[52] U.S. Cl. ..... 52/25.4; 52/25.41; 403/109; 403/377

[58] Field of Search ..... 135/25.1, 25.4, 135/25.41; 403/104, 109, 325, 529, 377, 378, 380

[56] References Cited

U.S. PATENT DOCUMENTS

| | | | |
|---|---|---|---|
| 4,858,633 | 8/1989 | Yang | 135/25.1 |
| 5,287,869 | 2/1994 | Wu | 135/25.1 |
| 5,387,048 | 2/1995 | Kuo | 135/25.1 |
| 5,702,198 | 12/1997 | Kuo | 135/25.1 |

*Primary Examiner*—Beth Aubrey
*Attorney, Agent, or Firm*—Rosenberg, Klein & Lee

[57] ABSTRACT

An improved umbrella rod structure of multiple tubes, in which the locating assembly includes a spring, a main body, and a plunger. The locating assembly is plugged into an inner tube, with a stop flange of the main body abutting against the lower end of the inner tube. Then, the conical front end of the plunger will retractably project out of a through hole of the inner tube. Using the recessed groove of the outer tube sliding over the elongated guide groove of the inner tube, the projecting end of the plunger will first engage with the lower aperature of the outer tube and then as the inner tube is drawn upwards to have a short rib of the main body abut against the upper segment of the recessed groove, which has a smaller curvature, the plunger will engage with the upper aperature to lock the inner tube and the outer tube in position. With such an arrangement, the inner tube and the outer tube can cooperate with each other to open or close an umbrella, without relative rotation motion therebetween.

1 Claim, 5 Drawing Sheets

UMBRELLA ROD STRUCTURE OF MULTIPLE TUBES

BACKGROUND OF THE INVENTION

As shown in FIGS. 1 and 2, a prior known umbrella rod consisted of multiple tubes including at least an outer tube (2*a*) and an inner tube (1*a*) between which a connector (3*a*) is used to combining both. The connector (3*a*) includes two stoppers (4*a*), (5*a*) having springs (41*a*), (51*a*) there around to engage with the outer tube (2*a*) and the inner tube (1*a*) respectively. The two stoppers (4*a*), (5*a*) are at different levels, which makes the manufacturing and assembling of the umbrella rod become difficult and troublesome.

SUMMARY OF THE INVENTION

In view of the above problem, the primary object of the present invention is to provide an improved connecting structure of umbrella rod having at least two tubes, which are capable of being easily connected and assembled. The structure of this umbrella rod can also obtain a secure positioning when the rod is stretched.

The present invention will now be described in detail with reference to the accompanying drawings.

DETAILED DESCRIPTION OF PREFERRED EMBODIMENTS

Figure 1:
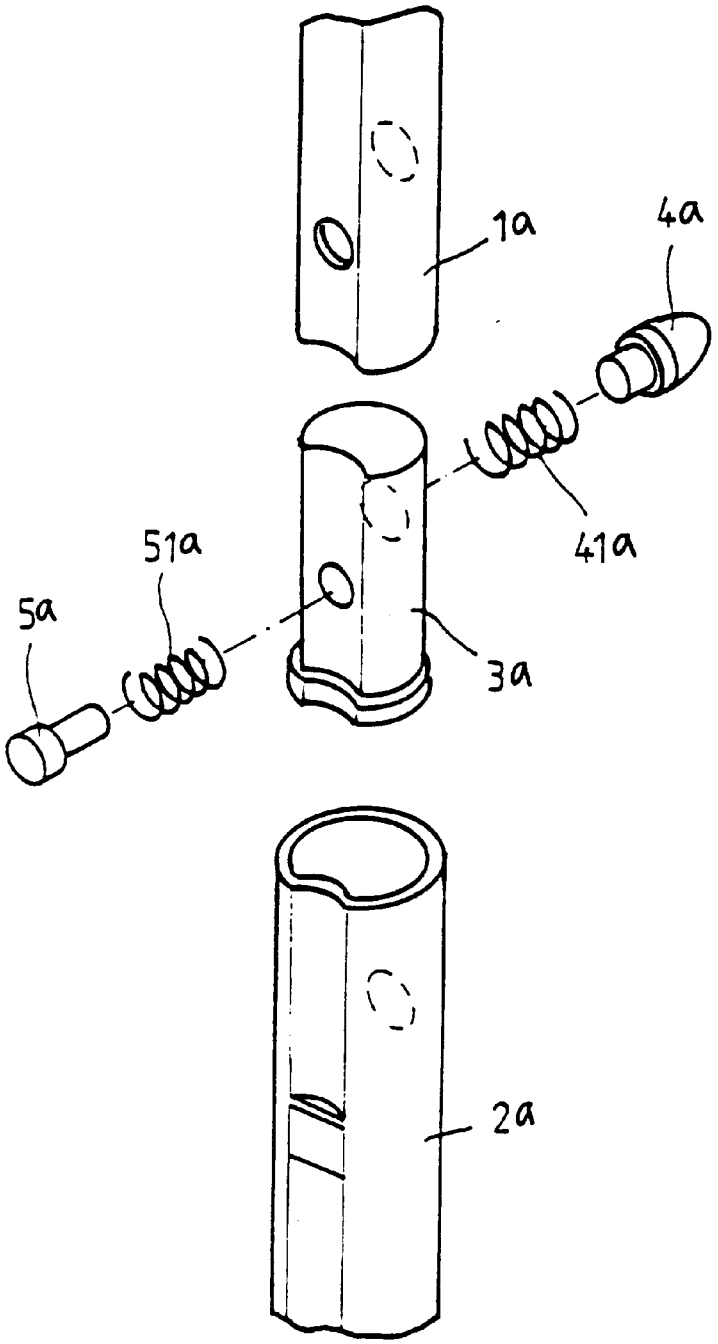
FIG. 1 (prior art)
FIG. 1 is an exploded perspective view of parts of a prior known umbrella rod.
Figure 2:
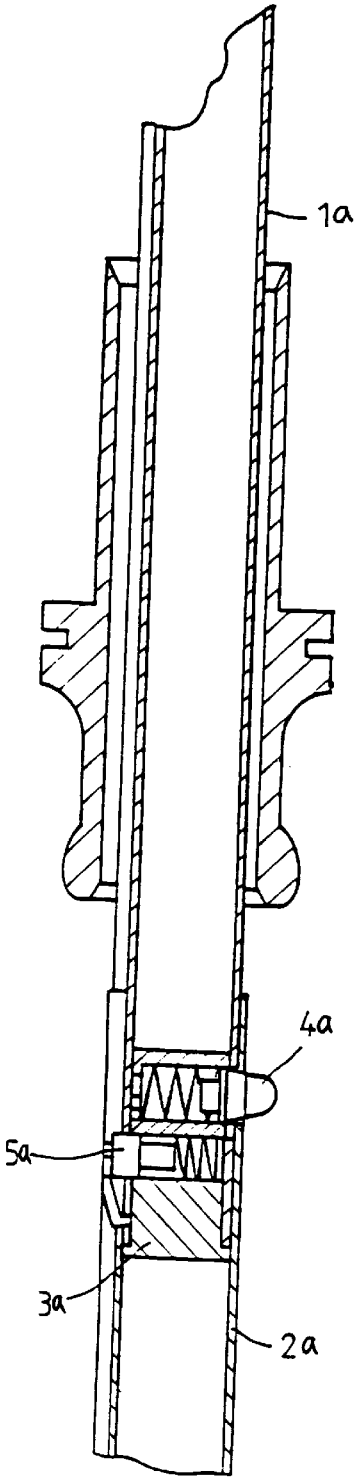
FIG. 2 (prior art)
FIG. 2 is a cross sectional plan view of a prior known umbrella rod assembly.
Figure 3:
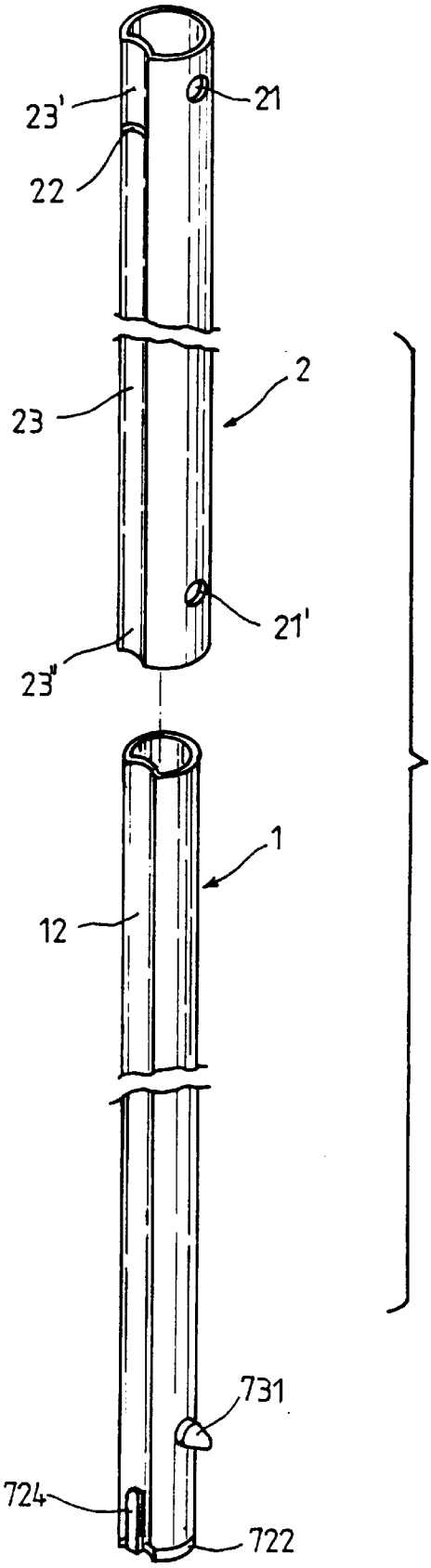
FIG. 3 is an exploded perspective view illustrating a preferred embodiment of a telescopic umbrella rod structure according to the present invention.
Figure 4:
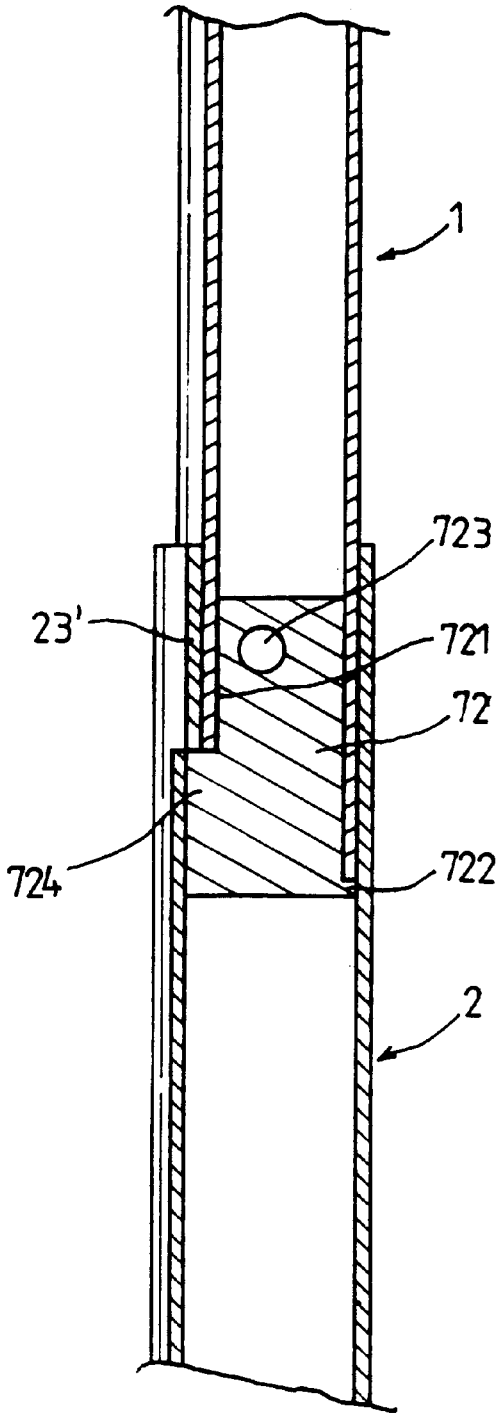
FIG. 4 is a cross sectional view of the telescopic umbrella rod structure of FIG. 3.
Figure 5:
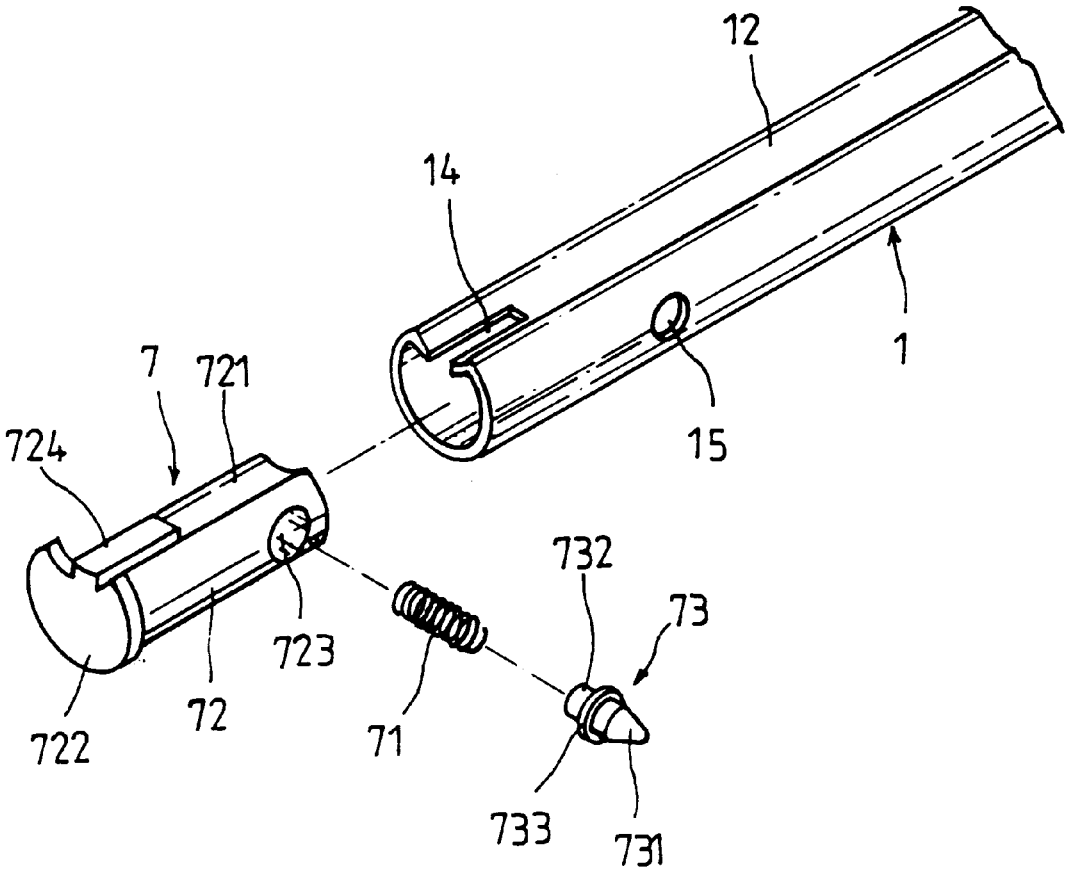
FIG. 5 is an exploded view showing the locating means according to the invention.

With reference to FIGS. 3, 4, and 5, the telescopic umbrella rod according to the invention has a longitudinally extending recessed groove (23) provided on the outer tube (2) as well as a stop portion (22) situated near the upper end of the recessed groove (23). The upper segment (23') of the recessed groove (23) beyond the stop portion (22) is configured to have a groove bottom with a curvature smaller than that of the groove bottom of the lower segment (23") below the stop portion (22). The outer tube (2) further includes an upper aperture (21) and a lower aperture (21') disposed on its cylindrical outer wall surface and aligned in a line, which enable a stop plunger to pass through. The inner tube (1) also has a longitudinal elongated guide groove (12) and an open-end slot (14) provided on the end of the guide groove (12). As shown in FIG. 5, a through hole (15) is formed on a side surface of the inner tube (1) perpendicular to the plane that the open-end slot lies on. Furthermore, the locating means (7) consist of a spring (71), a main body (72), and a plunger (73). The plunger (73) has a conical front end (731) and a rear end (732) having a smaller diameter, with a stop flange (733) disposed therebetween. Another stop flange (722), formed on the rear end of the main body (72), is configured to have the same outer contour as that of the lower end of the inner tube (1). The longer front portion (721) of the main body (72) has such a shape that it can be inserted into the lower end of the hollow inner tube (1). The longer front portion (721) has a hole (723) formed on its side surface, which allow the sequential insertion of a spring (71) and a plunger (73). The main body (72) integrates with a short rib (724), which is configured to fit into the open-end slot (14) with a height flush with the stop flange (722) of the main body (72). When the locating means (7) are plugged into the inner tube (1) until the stop flange (722) of the main body (72) abuts against the lower end of the inner tube (1), the conical front end (731) of the plunger (73) will retractably project out of the through hole (15) of the inner tube (1). When the inner tube (1) extends into the outer tube (2) with the recessed groove (23) of the outer tube (2) sliding over the elongated guide groove (12) of the inner tube (1), the projecting end of the plunger (73) will first engage with the lower aperature (21') of the outer tube (2). As the inner tube (1) is drawn upwards until the short rib (724) abuts against the upper segment (23') of the recessed groove (23) which has a smaller curvature, the plunger (73) engages with the upper aperature (21) to lock the inner tube in position. With such an arrangement, the inner and the outer tube can cooperate with each other to open and close umbrellas.

From the above description, the umbrella rod structure of the invention indeed has the advantages of enhancement of umbrella structures and performances as well as provides the convenience in use. Hence, the invention meets the essence of a patent. We hereby apply for a patent grant. with the stop flange of said main body; characterized in that when said locating means is placed into said inner tube, with the stop flange abutting against the lower end of said inner tube, the conical end of said plunger will retractably project out of the through hole of the inner tube so that when the inner tube extends into the outer tube, with the recessed groove of the outer tube sliding over the elongated guide groove of the inner tube, the projecting end of the plunger will first engage with the lower aperature of It the outer tube and then as the inner tube is drawn upwards to have the short rib abut against the upper segment of the recessed groove which has a smaller curvature, the plunger will engage with the upper aperature to lock the inner tube in position.

What is claimed is:

1. An improved umbrella rod structure of multiple tube, comprising:

an outer tube having a longitudinally extending recessed groove formed therein, a stop portion formed adjacent an upper end of said recessed groove, an upper aperture formed through an outer wall of said outer tube, and a lower aperture formed through said outer wall in longitudinally aligned relationship with said upper aperture, an upper portion of said recessed groove beyond said stop portion having a predetermined curvature and A lower portion having a curvature greater than said predetermined curvature of said upper portion;

an inner tube having a longitudinal elongated guide groove formed therein with an open-end slot formed in a hollow lower end of said inner tube and a through hole formed in a side surface which is perpendicular to a plane that said open-end slot lies in; and locating means consisting of a spring, a main body, and a plunger, said plunger having a conical front end and a rear end of a smaller diameter, with a stop flange disposed therebetween, said main body of said locating means being configured to have a stop flange with the same contour as said hollow lower end of said inner tube, said main body having a front portion suitable for insertion into said hollow lower end of said inner tube, a hole accommodating said spring and said plunger therein, and a short rib sized to fit in said open-end slot, said short rib having a height substantially equal to a height of said stop flange of said main body.

* * * * *